US008149129B2

(12) United States Patent
Ballinger

(10) Patent No.: US 8,149,129 B2
(45) Date of Patent: Apr. 3, 2012

(54) SIGNAL ALIGNMENT MONITORING SYSTEM AND METHOD OF ASSEMBLING THE SAME

(75) Inventor: Forrest Henry Ballinger, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 273 days.

(21) Appl. No.: 12/402,607

(22) Filed: Mar. 12, 2009

(65) Prior Publication Data

US 2010/0231414 A1 Sep. 16, 2010

(51) Int. Cl.
*G08B 3/00* (2006.01)

(52) U.S. Cl. ..... 340/686.2; 340/431; 340/686.1; 340/687; 340/691.6; 246/473 R; 246/473.1; 246/473.2; 246/473.3; 246/474; 362/253; 362/254; 362/256; 362/257; 362/258

(58) Field of Classification Search ..... 340/686.2, 340/431, 686.1, 687, 697.6, 693; 246/473 R–473 A; 362/253–286
See application file for complete search history.

(56) References Cited

U.S. PATENT DOCUMENTS

| | | | | |
|---|---|---|---|---|
| 5,556,070 | A | 9/1996 | Viebrock | |
| 6,222,446 | B1 | 4/2001 | Hilleary | |
| 6,222,457 | B1 * | 4/2001 | Mills et al. | 340/686.1 |
| 6,369,704 | B2 | 4/2002 | Hilleary | |
| 6,863,246 | B2 | 3/2005 | Kane et al. | |
| 7,053,784 | B2 | 5/2006 | Hatfield et al. | |
| 7,098,774 | B2 | 8/2006 | Davenport et al. | |
| 7,123,165 | B2 | 10/2006 | Davenport et al. | |
| 7,154,403 | B2 | 12/2006 | Davenport et al. | |
| 7,270,442 | B2 | 9/2007 | Davenport et al. | |
| 2005/0237215 | A1 * | 10/2005 | Hatfield et al. | 340/686.2 |

* cited by examiner

*Primary Examiner* — George Bugg
*Assistant Examiner* — Ojiako Nwugo
(74) *Attorney, Agent, or Firm* — GE Global Patent Operation; John A. Kramer

(57) ABSTRACT

A signal alignment monitoring system is provided. The system includes a signal assembly including at least one signal lamp. The system also includes an alignment monitoring apparatus coupled to the signal assembly. The alignment monitoring apparatus includes a source for emitting electromagnetic energy and a detector for sensing electromagnetic energy emitted by the source to facilitate determining an alignment of the signal assembly.

16 Claims, 3 Drawing Sheets

SIGNAL ALIGNMENT MONITORING SYSTEM AND METHOD OF ASSEMBLING THE SAME

BACKGROUND OF THE INVENTION

The field of this disclosure relates generally to warning signals and, more particularly, to a signal alignment monitoring system and a method of assembling the same.

At least some known highway-rail grade crossings have signal lamps to facilitate warning approaching motorists of oncoming trains. Because signal lamp misalignment can reduce the effectiveness of the warning, signal lamps are manually aligned during installation and periodically inspected thereafter for proper alignment. However, because manual inspection after installation is periodic, signal lamp misalignment may conceivably go unnoticed until the next inspection.

As such, an automated system for monitoring signal lamp alignment would facilitate improving railway crossing safety and reducing associated inspection costs.

BRIEF DESCRIPTION OF THE INVENTION

In one aspect, a signal alignment monitoring system is provided. The system includes a signal assembly including at least one signal lamp. The system also includes an alignment monitoring apparatus coupled to the signal assembly. The alignment monitoring apparatus includes a source for emitting electromagnetic energy and a detector for sensing electromagnetic energy emitted by the source to facilitate determining an alignment of the signal assembly.

In another aspect, a warning device for a highway-rail grade crossing is provided. The device includes a signal assembly including a support structure, a first signal lamp, and a second signal lamp. The support structure includes a mast, wherein the first and second signal lamps are attached to the mast for elevation of the first and second signal lamps above a ground level proximate a railroad crossing. The device also includes an alignment apparatus coupled to the signal assembly, the alignment apparatus including a source for casting electromagnetic energy on the first signal lamp and/or on the second signal lamp and a detector for sensing the electromagnetic energy cast on the first signal lamp and/or second signal lamp, the source and the detector being oriented so that the electromagnetic energy cast on the first signal lamp and/or on the second signal lamp and detected by the detector is indicative of an alignment or orientation of the signal assembly. The device further includes a control unit communicatively coupled to the alignment apparatus, wherein the control unit is configured to receive a signal from the alignment apparatus relating to the electromagnetic energy cast by the source and/or detected by the detector. The control unit being configured to generate data indicative of the alignment or orientation of the first signal lamp and/or the second signal lamp using the signal received from the alignment apparatus.

In another aspect, a method of assembling a signal alignment monitoring system is provided. The method includes providing a signal assembly including at least one signal lamp and coupling an alignment monitoring apparatus to the signal assembly. The alignment monitoring apparatus includes a source for emitting electromagnetic energy and a detector for sensing electromagnetic energy emitted by the source to facilitate determining an alignment of the signal assembly.

DETAILED DESCRIPTION OF THE INVENTION

The following detailed description illustrates exemplary signal alignment monitoring systems and methods of assembling the same by way of example and not by way of limitation. The description enables one of ordinary skill in the art to make and use the disclosure, and the description describes several embodiments, adaptations, variations, alternatives, and uses of the disclosure, including what is presently believed to be the best mode of carrying out the disclosure. The disclosure is primarily described herein as being applied to one exemplary embodiment, namely, signal alignment monitoring systems for use at highway-rail grade crossings. However, it is contemplated that this disclosure has general application to monitoring alignment in a broad range of systems and in a variety of industrial and/or consumer applications.

Figure 1:
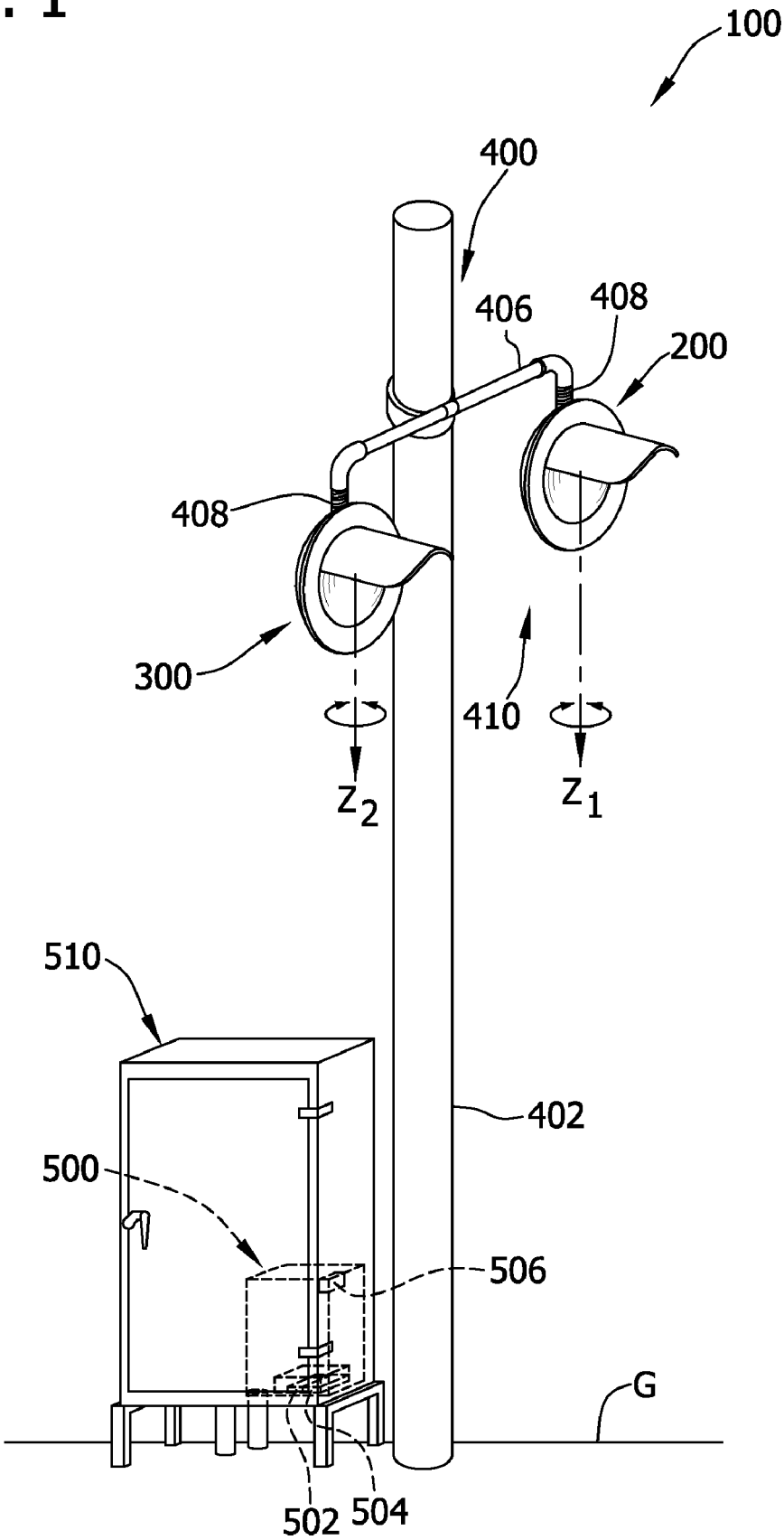
FIG. 1 is a perspective view of a warning device for use at a highway-rail grade crossing.

FIG. 1 is a perspective view of an exemplary warning device 100 for use at a railway crossing (e.g., a highway-rail grade crossing). Warning device 100 includes a signal assembly 410. In one embodiment, signal assembly 410 includes a first signal lamp 200 and a second signal lamp 300 mounted adjacent to one another on a support structure 400. In other embodiments, signal assembly 410 may include any suitable number of signal lamps and/or any other suitable signaling apparatus. In the exemplary embodiment, support structure 400 includes a mast 402 and a support arm 406. Mast 402 is erected from a foundation in the ground G proximate to a railroad crossing, and support arm 406 is coupled substantially perpendicular to mast 402 using any suitable fastener (e.g., a sleeve and a plurality of bolts) such that first signal lamp 200 and second signal lamp 300 are elevated above the ground G. First signal lamp 200 and second signal lamp 300 are rotatably mounted on support arm 406 (e.g., suspended from support arm 406 via a threaded engagement 408 with support arm 406) such that first signal lamp 200 and second signal lamp 300 are adjustable on horizontal and vertical planes. In other embodiments, support structure 400 may have any suitable number of support members arranged in any suitable orientation that enables warning device 100 to function as described herein.

Figure 2:
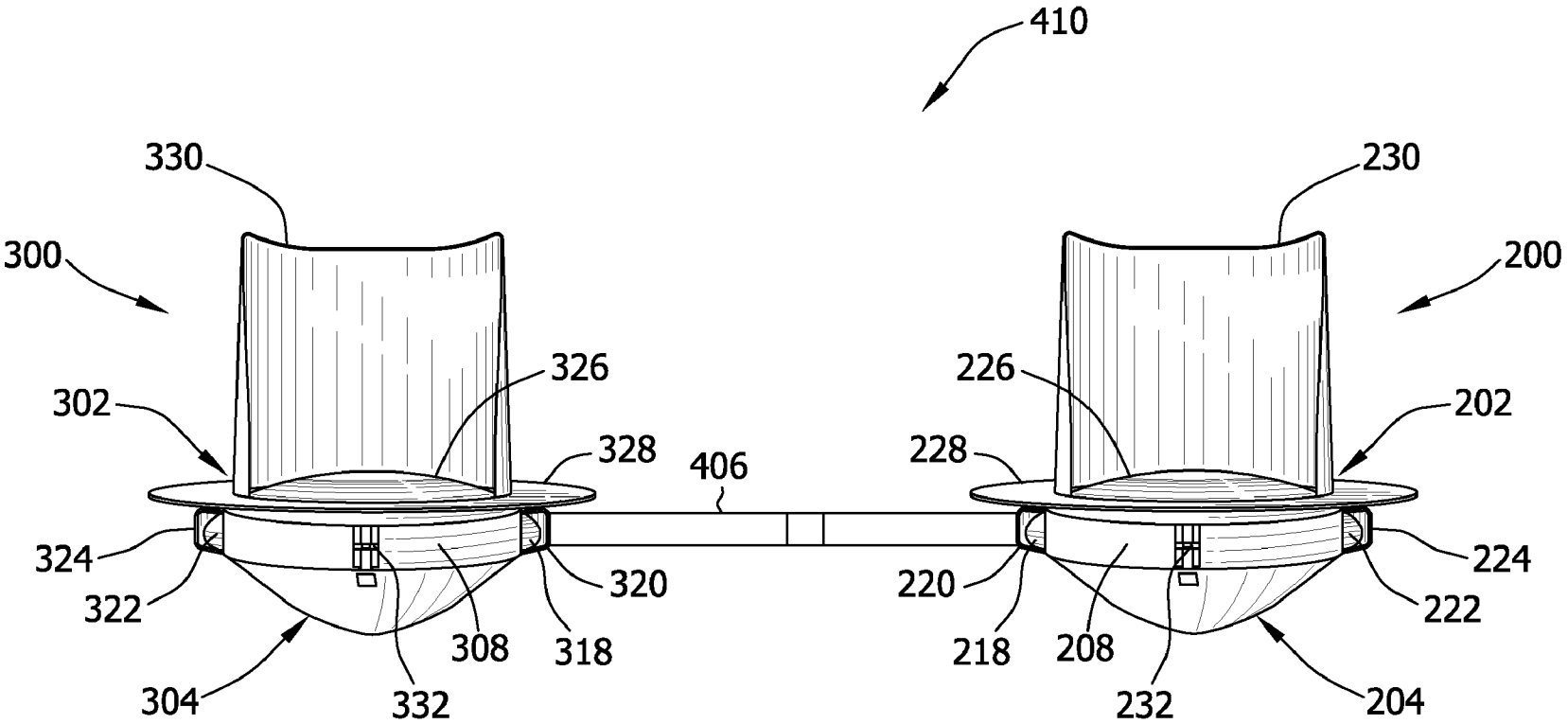
FIG. 2 is a bottom view of a signal for use in the warning device shown in FIG. 1.

FIG. 2 is a bottom view of signal assembly 410 suspended from support arm 406. In the exemplary embodiment, first signal lamp 200 includes a front housing 202 and a back housing 204. Back housing 204 includes an upper wall 206 (shown in FIG. 3), a lower wall 208, an inner sidewall 210 (shown in FIG. 3), and an outer sidewall 212 (shown in FIG. 3). An inner optical port 214 (shown in FIG. 3) is defined on inner sidewall 210, and an outer optical port 216 (shown in FIG. 3) is defined on outer sidewall 212. An inner lens 218 covers inner optical port 214, and an inner hood 220 extends outwardly from inner sidewall 210 about inner optical port 214. An outer lens 222 covers outer optical port 216, and an outer hood 224 extends outwardly from outer sidewall 212 about outer optical port 216. Front housing 202 includes a front lens 226, a background disc 228 circumscribing front lens 226 and extending radially outwardly therefrom, and a front hood 230 extending substantially perpendicularly from background disc 228 about front lens 226. Front housing 202 is removably coupled to back housing 204 via any suitable fasteners (e.g., a hinge 232). In one embodiment, first signal lamp 200 (i.e., front housing 202 and back housing 204) is pivotable about an axis $Z_1$ (shown in FIGS. 1 and 3) extending substantially perpendicular to support arm 406. In other embodiments, first signal lamp 200 may be pivotable in any suitable direction (e.g., about an axis perpendicular to axis $Z_1$). In alternative embodiments, first signal lamp 200 may have any suitable housing configuration and is not limited to the above-described configuration. As used herein, the term "lens" refers to any transparent or translucent material and is not limited to transparent or translucent materials that refract light.

In the exemplary embodiment, second signal lamp 300 includes a front housing 302 and a back housing 304. Back housing 304 includes an upper wall 306 (shown in FIG. 3), a lower wall 308, an inner sidewall 310 (shown in FIG. 3), and an outer sidewall 312 (shown in FIG. 3). An inner optical port 314 (shown in FIG. 3) is defined on inner sidewall 310, and an outer optical port 316 (shown in FIG. 3) is defined on outer sidewall 312. An inner lens 318 covers inner optical port 314, and an inner hood 320 extends outwardly from inner sidewall 310 about inner optical port 314. An outer lens 322 covers outer optical port 316, and an outer hood 324 extends outwardly from outer sidewall 312 about outer optical port 316. Front housing 302 includes a front lens 326, a background disc 328 circumscribing front lens 326 and extending radially outwardly therefrom, and a front hood 330 extending substantially perpendicularly from background disc 328 about front lens 326. Front housing 302 is removably coupled to back housing 304 via any suitable fasteners (e.g., a hinge 332). In one embodiment, second signal lamp 300 (i.e., front housing 302 and back housing 304) is pivotable about an axis $Z_2$ (shown in FIGS. 1 and 3) extending substantially perpendicular to support arm 406. In another embodiment, second signal lamp 300 may be pivotable in any suitable direction (e.g., about an axis perpendicular to axis $Z_2$). In other embodiments, second signal lamp 300 may have any suitable housing configuration and is not limited to the above-described configuration. Optionally, the housing configuration of first signal lamp 200 and second signal lamp 300 may be identical such that first signal lamp 200 and second signal lamp 300 are interchangeably mountable on either end of support arm 406 and/or elsewhere.

Figure 3:
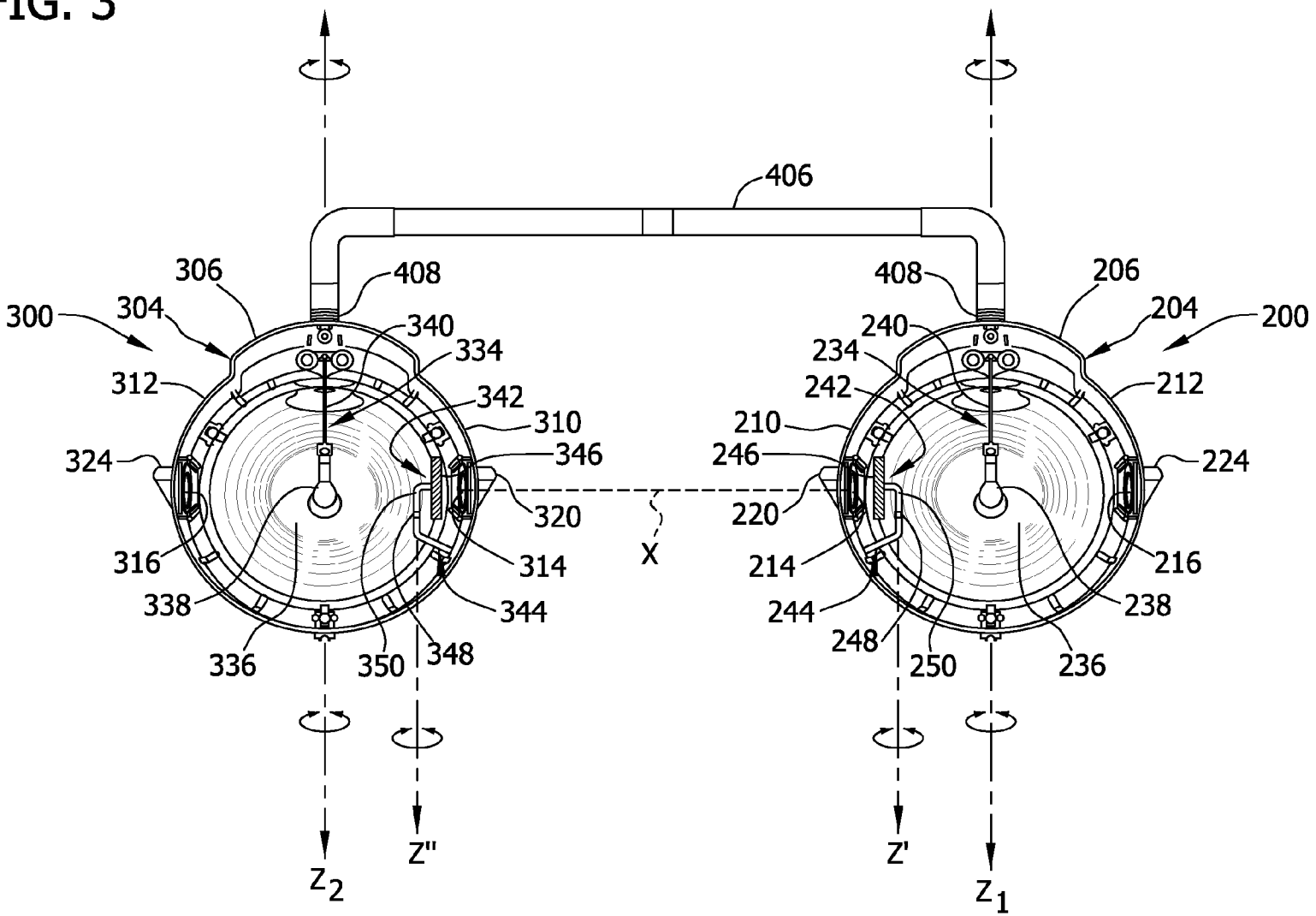
FIG. 3 is a front view of a portion of the signal shown in FIG. 2.

FIG. 3 is a front view of first signal lamp 200 and second signal lamp 300 with front housings 202, 302 removed. In the exemplary embodiment, first signal lamp 200 includes a light assembly 234. Light assembly 234 includes a mirror 236 and a warning light 238 (e.g., an incandescent light bulb) mounted within back housing 204. In the exemplary embodiment, mirror 236 has a substantially parabolic contour. In other embodiments, mirror 236 may have any suitable contour that enables first signal lamp 200 to function as described herein. In the exemplary embodiment, warning light 238 is suspended at a focal point of mirror 236 via a bracket 240 such that light emitted from warning light 238 is directed through front lens 226 (shown in FIG. 2) via mirror 236 and through outer optical port 216. Alternatively, the incandescent bulb of light assembly 234 may be replaced with either an LED array and/or any other suitable light emitting device, or light assembly 234 may be entirely replaced by an LED array and/or any other suitable light emitting device mounted in any suitable location within back housing 204 that enables first signal lamp 200 to function as described herein.

In the exemplary embodiment, second signal lamp 300 includes a light assembly 334. Light assembly 334 includes a mirror 336 and a warning light 338 (e.g., an incandescent light bulb) mounted within back housing 304. In the exemplary embodiment, mirror 336 has a substantially parabolic contour. In other embodiments, mirror 336 may have any suitable contour that enables second signal lamp 300 to function as described herein. In the exemplary embodiment, warning light 338 is suspended at a focal point of mirror 336 via a bracket 340 such that light emitted from warning light 338 is directed through front lens 326 (shown in FIG. 2) via mirror 336 and through outer optical port 316. Alternatively, the incandescent bulb of light assembly 334 may be replaced with either an LED array and/or any other suitable light emitting device, or light assembly 334 may be entirely replaced by an LED array and/or any other suitable light emitting device mounted in any suitable location within back housing 304 that enables second signal lamp 300 to function as described herein.

In the exemplary embodiment, first signal lamp 200 includes an alignment monitoring apparatus 242 mounted on a frame 244 within back housing 204 adjacent inner optical port 214. Alignment monitoring apparatus 242 includes a source for casting electromagnetic energy and/or a detector for sensing electromagnetic energy. In the exemplary embodiment, the source is a laser diode that emits spatially coherent light (e.g., a laser beam), and the detector is a photodiode that senses light. In one embodiment, the source and the detector are fabricated as a single package 246 (e.g., a single semiconductor package). In alternative embodiments, alignment monitoring apparatus 242 may include any device that emits and/or detects any suitable wavelength of electromagnetic energy that enables alignment monitoring apparatus 242 to function as described herein.

In the exemplary embodiment, alignment monitoring apparatus 242 also includes an RF transmitter for transmitting a signal indicative of electromagnetic energy emitted by the source and/or electromagnetic energy sensed by the detector to a control unit 500 (shown in FIG. 1). In other embodiments, alignment monitoring apparatus 242 includes any suitable communications device. Optionally, alignment monitoring apparatus 242 may be coupled to frame 244 using any suitable mounting arrangement (e.g., mechanical fasteners and/or adhesives) such that the source is oriented to emit electromagnetic energy through inner optical port 214 along an axis X and such that the detector is oriented to sense electromagnetic energy received through inner optical port 214. In one embodiment, frame 244 is either coupled to or formed with back housing 204 and includes a joint 248 such that alignment monitoring apparatus 242 and an upper portion 250 of frame 244 are pivotable about an axis Z' that is substantially parallel to axis $Z_1$, thereby enabling an orientation of alignment monitoring apparatus 242 to be adjusted independently from back housing 204 and locked into a fixed position via any suitable locking mechanism. In another embodiment, frame 244 and/or alignment monitoring apparatus 242 may be permanently fixed in any given direction or may be adjustable vertically (e.g., joint 248 may be telescopic) and/or in any other suitable direction.

In the exemplary embodiment, second signal lamp 300 includes a reflection apparatus 342 mounted on a frame 344 within back housing 304 adjacent inner optical port 314. In one embodiment, reflection apparatus 342 has a reflective surface 346 that reflects light (e.g., reflection apparatus 342 is a mirror). In other embodiments, reflection apparatus 342 may include any suitable number of reflective surfaces (e.g., formed integrally together or separately from one another) that facilitate reflecting any suitable wavelength of electromagnetic energy. In the exemplary embodiment, reflection apparatus 342 is coupled to frame 344 using any suitable mounting arrangement (e.g., mechanical fasteners and/or adhesives) such that reflective surface 346 is oriented to reflect toward the detector the electromagnetic energy emitted by the source. In one embodiment, frame 344 is either coupled to or formed with back housing 304 and includes a joint 348 such that reflection apparatus 342 and an upper portion 350 of frame 344 are pivotable about an axis Z" that is substantially parallel to axis $Z_2$, thereby enabling an orientation of reflection apparatus 342 to be adjusted independently from back housing 304 and locked into a fixed position via any suitable locking mechanism. In another embodiment, frame 344 and/or reflection apparatus 342 may be permanently fixed in any given direction or may be adjustable vertically (e.g., joint 348 may be telescopic) and/or in any other suitable direction.

Control unit 500 is coupled in communication with alignment monitoring apparatus 242 (e.g., via electric wiring, a wireless system, and/or any other communication medium). In the exemplary embodiment, control unit 500 is suitable for outdoor use and includes a recorder 502 (e.g., a solid-state memory) and a modem 504 that communicates with alignment monitoring apparatus 242, communicates to a location remote from warning device 100 (e.g., a central traffic control center), and/or enables data to be stored in recorder 502 (e.g., recorder 502 may be a recording device such as, for example, a Highway Crossing Analyzer available from Harmon Industries, Inc.). In other embodiments, control unit 500 may include any suitable control unit memory and/or any suitable control unit controller in lieu of, or in addition to, recorder 502 and/or modem 504, respectively. In one embodiment, control unit 500 also includes at least one communication device (e.g., a universal serial bus (USB) port, a wired or wireless receiving/transmitting device (e.g., an RF receiver 506), and/or any other suitable communication device) to facilitate communicating with a system remote from warning device 100 (e.g., a communications system at a central traffic control center) and/or with alignment monitoring apparatus 242 (e.g., via electric wiring, a wireless system, and/or any other communication medium). As used herein, the term controller may include any suitable RF receiver, logic, recorder, and/or any processor-based or microprocessor-based system that includes microcontrollers, reduced instruction set circuits (RISC), application-specific integrated circuits (ASICs), logic circuits, and any other circuit or processor that is capable of executing the functions described herein. The examples provided above are exemplary only, and are not intended to limit in any way the definition and/or meaning of the term controller.

In one embodiment, control unit 500 is housed within a signal case 510 positioned proximate to the railway (i.e., signal case 510 may suitably house various other electronic railway equipment, such as, for example, power supply equipment, train detection equipment, signaling equipment, etc.). In other embodiments, control unit 500 may be mounted at any suitable location on or remotely from warning device 100. In the exemplary embodiment, control unit 500 may be powered using any suitable power source. In one embodiment, control unit 500 may be powered via the wiring provided for powering either warning light 238 and/or warning light 338. Optionally, control unit 500 may also include at least one user interface (e.g., an indicator light). In other embodiments, the user interface may utilize any suitable display technology to display information associated with an orientation of first signal lamp 200, second signal lamp 300, and/or support structure 400 to a user.

To assemble warning device 100, a user refers to railroad instructions to facilitate properly erecting mast 402 and/or orienting first signal lamp 200 and/or second signal lamp 300. With the guidance of the railroad instructions, the user orients first signal lamp 200 and/or second signal lamp 300 (e.g., via pivoting about axes $Z_1$ and $Z_2$, respectively) such that, when light is emitted from warning lights 238, 338, a first portion of the emitted light is reflected by mirrors 236, 336, is shaped into beams by front lenses 226, 326, and is directed toward oncoming motorists. As such, when light is emitted from warning lights 238, 338, a second portion of the emitted light is visible to oncoming trains through outer optical ports 216, 316, respectively, to facilitate notifying oncoming trains that warning device 100 is functional (i.e., that warning device 100 is alerting oncoming motorists). After orienting first signal lamp 200 and/or second signal lamp 300 according to the railroad instructions, the user removes front housings 202, 302 from back housings 204, 304, respectively, (e.g., via hinges 232, 332) to access alignment monitoring apparatus 242 and/or reflection apparatus 342.

With front housings 202, 302 removed, the user adjusts frames 244, 344 (i.e., pivots frame upper portions 250, 350 about axes Z' and Z" via joints 248, 348, respectively) such that alignment monitoring apparatus 242 and/or reflection apparatus 342 are locked into a "zero" orientation. In the zero orientation, the source is oriented such that, when electromagnetic energy (e.g., a laser beam) is emitted therefrom, at least a portion of the emitted energy is directed through inner optical port 214, through inner lens 218, through inner lens 318, and through inner optical port 314, and is reflected by reflective surface 346 back through inner optical port 314, back through inner lens 318, back through inner lens 218, back through inner optical port 214, and onto a detection zone of the detector. After orienting alignment monitoring apparatus 242 and/or reflection apparatus 342 into the zero orientation, the user locks frames 244, 344 into a fixed position and couples front housings 202, 302 to back housings 204, 304, respectively, such that warning device 100 is completely assembled. In an alternative embodiment, the user may operate at least one motor coupled to warning device 100 to facilitate adjusting signal lamps 200, 300 and/or frames 244, 344 as described herein.

In the exemplary embodiment, alignment monitoring apparatus 242 is powered via the wiring provided for powering either warning light 238 and/or warning light 338 such that the source emits electromagnetic energy toward the detector and/or the detector senses electromagnetic energy emitted by the source on substantially the same time intervals (e.g., about one pulse per second) as warning lights 238, 338 emit light through front lenses 226, 326 (i.e., the source and/or the detector are active when warning lights 238, 338 are active, and the source and/or the detector are inactive when warning lights 238, 338 are inactive). In other embodiments, alignment monitoring apparatus 242 may be powered via any suitable source across any suitable medium.

In other embodiments, any suitable arrangement of alignment monitoring apparatus 242 and/or reflection apparatus 342 may be utilized to facilitate monitoring an alignment of warning device 100. Specifically, in one embodiment, warning device 100 may not include reflection apparatus 342, and the detector may be mounted within second signal lamp 300 in a manner similar to that in which reflection apparatus 342 is mounted within second signal lamp 300, such that the source is mounted on first frame 244 and the detector is mounted on second frame 344 to facilitate emitting electromagnetic energy from the source of first signal lamp 200 to the detector of second signal lamp 300. In another embodiment, the source may be mounted within first signal lamp 200, the detector may be mounted within second signal lamp 300, and reflection apparatus 342 may be mounted on support structure 400 (e.g., on mast 402) to facilitate emitting electromagnetic energy from the source and reflecting the electromagnetic energy off of reflection apparatus 342 and onto the detector such that a misalignment of either first signal lamp 200, second signal lamp 300, and/or support structure 400 relative to one another is facilitated being monitored. In alternative embodiments, alignment monitoring apparatus 242 and reflection apparatus 342 may be mounted on signal assembly 410, support structure 400, and/or any nearby dedicated reference point (e.g., a separate post proximate to warning device 100) to facilitate emitting electromagnetic energy from the source and onto the detector along any suitable path such that an alignment of first signal lamp 200, second signal lamp 300, and/or support structure 400 relative to one another and/or relative to the ground G is facilitated being monitored.

During operation of the exemplary embodiment, control unit 500 monitors an orientation of first signal lamp 200, second signal lamp 300, and/or support structure 400 relative to one another and/or relative to the ground G. In one embodiment, the detector and/or control unit 500 function as an absolute gauge of alignment. Specifically, the detector either senses or does not sense electromagnetic energy emitted by the source onto the detection zone, such that the detector does not sense displacement of the electromagnetic energy within the detection zone. As such, if the detector senses within the detection zone electromagnetic energy emitted by the source, the detector transmits a signal indicative of proper alignment to control unit 500. If the detector does not sense within the detection zone electromagnetic energy emitted by the source, no signal is transmitted from the detector to control unit 500, and control unit 500 generates an "alignment monitor error." In another embodiment, the detector functions as an active gauge of alignment. Specifically, the detector senses displacements from the zero orientation within the detection zone of the electromagnetic energy emitted by the source and transmits a signal corresponding to each sensed displacement to control unit 500. As such, if control unit 500 determines that the electromagnetic energy has been displaced within the detection zone beyond a predetermined orientation tolerance around the zero orientation, control unit 500 generates an alignment monitor error.

In the exemplary embodiment, a surface area of the detection zone and/or the predetermined orientation tolerance may be sized to sense any suitable quantity of misalignment. In one embodiment, the surface area of the detection zone and/or the predetermined orientation tolerance may be sized larger to permit greater misalignment before control unit 500 generates an alignment monitor error. In another embodiment, the surface area of the detection zone and/or the predetermined orientation tolerance may be sized smaller to permit lesser misalignment before control unit 500 generates an alignment monitor error. Optionally, in other embodiments, control unit 500 could be equipped with additional devices programmed to iteratively request and/or receive from alignment monitoring apparatus 242, at any predetermined time interval using any suitable communication device and any suitable communication medium, signals that are indicative of electromagnetic energy emitted by the source and/or sensed by the detector, and control unit 500 may be programmed to store a record of the alignment in the control unit memory and/or to transmit a signal indicative of the alignment to a location remote from warning device 100 (e.g., a central traffic control center).

In the exemplary embodiment, if alignment monitoring apparatus 242 (e.g., the RF transmitter) generates a signal (e.g., an RF signal in the range of about 20 kHz or less) indicative of an alignment of warning device 100 and transmits the signal to RF receiver 506 via the wiring that provides power to either warning light 238 and/or warning light 338, the signal is received at signal case 510 by RF receiver 506. Specifically, RF receiver 506 produces an output that is applied to a logic circuit communicatively coupled to recorder 502, which may be equipped with modem 504, such that, if the logic circuit indicates that warning lights 238, 338 are active and that no signal has been received from the detector, recorder 502 is programmed to transmit a signal indicative of an alignment monitor error to a location remote from warning device 100 (i.e., a central traffic control center or any other suitable location) to facilitate notifying maintenance of the misalignment. Optionally, the output from RF receiver 506 may be transmitted directly to recorder 502 such that internal logic of recorder 502 facilitates determining whether a signal indicative of an alignment monitor error should be transmitted to the remote location.

In one embodiment, control unit 500 is programmed to detect a malfunction of either the RF transmitter, the source, the detector, and/or any other suitable component of alignment monitoring apparatus 242. Additionally, signal assembly 410, support structure 400, and/or any subcomponent thereof may optionally be provided as a kit (e.g., a retrofit kit) to facilitate fabricating new signaling devices and/or retrofitting existing signaling devices. Furthermore, the methods and systems described herein may provide a method of operating a signaling device (e.g., a method of detecting alignment of a wayside signal, the method including transmitting electromagnetic radiation from a first location on the wayside signal to a second location on the wayside signal; detecting the electromagnetic radiation received at the second location; and determining an alignment of the first location relative to the second location based on detected electromagnetic radiation).

As will be appreciated by one skilled in the art and based on the foregoing specification, the above-described embodiments of the invention may be implemented using computer programming or engineering techniques including computer software, firmware, hardware, or any combination or subset thereof, wherein one technical effect is monitoring signal alignment. Any resulting program, having computer-readable code means, may be embodied or provided within one or more computer-readable media, thereby making a computer program product, i.e., an article of manufacture, according to the discussed embodiments of the invention. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, and/or by transmitting the code over a network.

The methods and systems described herein facilitate monitoring signal alignment. Specifically, the methods and systems described herein facilitate providing notification of signal misalignment to facilitate minimizing the time required to properly align the signal. As such, the methods and systems described herein facilitate increasing the reliability of a warning device and facilitate reducing an inspection cost associated with maintaining a warning device, thereby increasing the effectiveness of the warning device.

Exemplary embodiments of signal alignment monitoring systems and methods of assembling the same are described above in detail. The methods and systems are not limited to the specific embodiments described herein, but, rather, some components of the methods and systems may be utilized independently and separately from other components. For example, the methods and systems described herein may have other industrial and/or consumer applications and are not limited to practice with railway systems. Rather, the present invention can be implemented and utilized in connection with many other industries.

While the invention has been described in terms of various specific embodiments, those skilled in the art will recognize that the invention can be practiced with modification within the spirit and scope of the claims.

What is claimed is:

1. A signal alignment monitoring system comprising:

a signal assembly comprising at least one signal lamp; and an alignment monitoring apparatus coupled to said signal assembly, said alignment monitoring apparatus comprising a source for emitting electromagnetic energy and a detector for sensing electromagnetic energy emitted by said source to facilitate determining an alignment of said signal assembly;

wherein said signal assembly comprises a first signal lamp and a second signal lamp mounted adjacent said first signal lamp, said source coupled to said first signal lamp, said detector coupled to said second signal lamp, such that said source and said detector are oriented toward one another.

2. A signal alignment monitoring system comprising:

a signal assembly comprising at least one signal lamp;

an alignment monitoring apparatus coupled to said signal assembly, said alignment monitoring apparatus comprising a source for emitting electromagnetic energy and a detector for sensing electromagnetic energy emitted by said source to facilitate determining an alignment of said signal assembly; and a reflective surface for reflecting toward said detector electromagnetic energy emitted by said source;

wherein said signal assembly comprises a first signal lamp and a second signal lamp, said alignment monitoring apparatus coupled to said first signal lamp, said reflective surface coupled to said second signal lamp.

3. A system in accordance with claim 2, wherein said alignment monitoring apparatus is pivotably coupled to said first signal lamp and wherein said reflective surface is pivotably coupled to said second signal lamp such that said alignment monitoring apparatus and said reflective surface are pivotably orientable toward one another.

4. A system in accordance with claim 3, wherein said first signal lamp comprises a first housing, said first housing comprising a first inner optical port, wherein said alignment monitoring apparatus is positioned within said first housing and adjacent said first inner optical port, and wherein said second signal lamp comprises a second housing, said second housing comprising a second inner optical port, wherein said reflective surface is positioned within said second housing and adjacent said second inner optical port, such that said source is pivotably orientable to emit electromagnetic energy through said first inner optical port of said first signal lamp and through said second inner optical port of said second signal lamp, said reflective surface is pivotably orientable to reflect electromagnetic energy emitted by said source and received through said second inner optical port back through said second inner optical port and back through said first inner optical port of said first signal lamp, and said detector is pivotably orientable to sense electromagnetic energy reflected by said reflective surface and received through said first inner optical port of said first signal lamp.

5. A signal alignment monitoring system comprising: a signal assembly comprising two signal lamp; an alignment monitoring apparatus coupled to said signal assembly, said alignment monitoring apparatus comprising a source mounted on a first lamp for emitting electromagnetic energy; and a detector mounted on a second lamp for sensing electromagnetic energy emitted by said source to facilitate determining an alignment of said signal assembly; and further comprising a control unit communicatively coupled to said alignment monitoring apparatus, wherein said control unit is configured to receive a signal from said alignment monitoring apparatus that is indicative of at least one of electromagnetic energy emitted by said source and electromagnetic energy sensed by said detector, said control unit configured to generate data indicative of an orientation of at least one of said first signal lamp and said second signal lamp using the signal received from said alignment monitoring apparatus.

6. A system in accordance with claim 5, wherein said control unit is configured to determine that at least one of said first signal lamp and said second signal lamp is misaligned.

7. A system in accordance with claim 6, wherein said control unit comprises a memory, said control unit configured to generate a misalignment signal when at least one of said first signal lamp and said second signal lamp is misaligned, said control unit configured to store a record of the misalignment signal in said memory.

8. A system in accordance with claim 7, wherein said control unit is configured to transmit the misalignment signal to a location remote from said control unit.

9. A warning device for a highway-rail grade crossing, said device comprising: a signal assembly comprising a support structure, a first signal lamp, and a second signal lamp, said support structure including a mast, wherein the first and second signal lamps are attached to the mast for elevation of the first and second signal lamps above a ground level proximate a railroad crossing; and an alignment apparatus coupled to the signal assembly, said alignment apparatus comprising a source for casting electromagnetic energy on the first signal lamp and/or on the second signal lamp and a detector for sensing the electromagnetic energy cast on said first signal-lamp and/or second signal lamp, said source and said detector coupled to first and/or second signal lamp and being oriented so that the electromagnetic energy; cast on the first signal lamp and/or on the second signal lamp and detected by the detector is indicative of an alignment or orientation of the signal assembly; and a control unit communicatively coupled to the alignment apparatus, wherein said control wait is configured to receive a signal from the alignment apparatus relating to the electromagnetic energy cast by the source and/or detected by the detector, said control unit being configured to generate data indicative of the alignment or orientation of the first signal lamp and/or the second signal lamp using the signal received from the alignment apparatus.

10. A method of assembling a signal alignment monitoring system, said method comprising:

providing a signal assembly including at least one signal lamp; and coupling an alignment monitoring apparatus to the signal assembly, the alignment monitoring apparatus including a source for emitting electromagnetic energy and a detector for sensing electromagnetic energy emitted by the source to facilitate determining an alignment of the signal assembly;

wherein providing a signal assembly comprises providing a first signal lamp and a second signal lamp and wherein coupling an alignment monitoring apparatus to the signal assembly comprises:

coupling the source to the first signal lamp; and coupling the detector to the second signal lamp such that the source and the detector are configured to be oriented toward one another when the first signal lamp is mounted adjacent the second signal lamp.

11. A method of assembling a signal alignment monitoring system, said method comprising:

providing a signal assembly including at least one signal lamp;

coupling an alignment monitoring apparatus to the signal assembly, the alignment monitoring apparatus including a source for emitting electromagnetic energy and a detector for sensing electromagnetic energy; and providing a reflective surface for reflecting toward the detector electromagnetic energy emitted by the source;

wherein providing a signal assembly including at least one signal lamp comprises providing a first signal lamp and a second signal lamp and wherein coupling an alignment monitoring apparatus to the signal assembly comprises coupling the alignment monitoring apparatus to the first signal lamp, said method further comprising:

coupling the reflective surface to the second signal lamp such that the alignment monitoring apparatus and the reflective surface are configured to be oriented toward one another when the first signal lamp is mounted adjacent the second signal lamp.

12. A method in accordance with claim 11, wherein coupling the alignment monitoring apparatus to the first signal lamp comprises pivotably coupling the alignment monitoring apparatus to the first signal lamp and wherein coupling the reflective surface to the second signal lamp comprises pivotably coupling the reflective surface to the second signal lamp such that the alignment monitoring apparatus and the reflective surface are pivotably orientable toward one another when the first signal lamp is mounted adjacent the second signal lamp.

13. A method in accordance with claim 12, wherein providing a first signal lamp and a second signal lamp comprises:

providing the first signal lamp with a housing, wherein the housing of the first signal lamp includes an inner optical port, the alignment monitoring apparatus positioned within the housing of the first signal lamp and adjacent the inner optical port of the first signal lamp; and providing the second signal lamp with a housing, wherein the housing of the second signal lamp includes an inner optical port, the reflective surface positioned within the housing of the second signal lamp and adjacent the inner optical port of the second signal lamp, such that when the first signal lamp is mounted adjacent the second signal lamp the source is pivotably orientable to emit electromagnetic energy through the inner optical port of the first signal lamp and through the inner optical port of the second signal lamp, the reflective surface is pivotably orientable to reflect electromagnetic energy emitted by the source and received through the inner optical port of the second signal lamp back through the inner optical port of the second signal lamp and back through the inner optical port of the first signal lamp, and the detector is pivotably orientable to sense electromagnetic energy reflected by the reflective surface and received through the inner optical port of the first signal lamp.

14. A method of assembling a signal alignment monitoring system, said method comprising:

providing a signal assembly including two signal lamps: coupling an alignment monitoring apparatus to the signal assembly, the alignment monitoring apparatus including a source for emitting electromagnetic energy mounted on a first lamp and a detector mounted on a second lamp for sensing electromagnetic energy emitted by the source to facilitate determining, an alignment of the signal assembly;

providing a control unit; and communicatively coupling the control unit to the alignment monitoring apparatus, wherein the control unit is configured to receive a signal from the alignment monitoring apparatus that is indicative of at least one of electromagnetic energy emitted by the source and electromagnetic energy sensed by the detector, the control unit configured to generate data indicative of an orientation of at least one of the first signal lamp and the second signal lamp using the signal received from the alignment monitoring apparatus.

15. A method in accordance with claim 14, wherein providing a control unit comprises providing a control unit that is configured to determine that at least one of the first signal lamp and the second signal lamp is misaligned.

16. A method in accordance with claim 15, wherein providing a control unit further comprises providing the control unit with a memory, the control unit configured to generate a misalignment signal when at least one of the first signal lamp and the second signal lamp is misaligned, to store a record of the misalignment signal in the memory, and to transmit the misalignment signal to a location remote from the control unit.

* * * * *